US007739879B2

(12) United States Patent
Sellers et al.

(10) Patent No.: US 7,739,879 B2
(45) Date of Patent: Jun. 22, 2010

(54) METHODS AND APPARATUS TO REDUCE OR PREVENT BRIDGING IN AN ICE STORAGE BIN

(75) Inventors: David Anglin Sellers, Newnan, GA (US); Yukihiko Suzuki, Peachtree City, GA (US); Milaim Hoti, Fayetteville, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 522 days.

(21) Appl. No.: 11/753,441

(22) Filed: May 24, 2007

(65) Prior Publication Data

US 2007/0273259 A1 Nov. 29, 2007

Related U.S. Application Data

(60) Provisional application No. 60/808,008, filed on May 24, 2006.

(51) Int. Cl.
*F25C 5/18* (2006.01)

(52) U.S. Cl. ..... 62/66; 62/344; 222/226

(58) Field of Classification Search ..... 62/344, 62/66; 222/226, 235
See application file for complete search history.

(56) References Cited

U.S. PATENT DOCUMENTS

| | | | | |
|---|---|---|---|---|
| 1,957,594 | A | 5/1934 | Helm | |
| 2,085,314 | A | 6/1937 | Hamilton | |
| 2,554,669 | A | 5/1951 | Elofson | |
| 2,842,175 | A | 7/1958 | Thompson | |
| 2,860,027 | A | 11/1958 | Swanson et al. | |
| 3,048,304 | A | 8/1962 | Polzin | |
| 3,165,240 | A * | 1/1965 | Maquelin | 222/457 |
| 3,276,224 | A * | 10/1966 | Lunde | 62/344 |
| 3,289,430 | A | 12/1966 | Dedricks et al. | |
| 3,430,452 | A | 3/1969 | Dedricks et al. | |
| 3,449,920 | A | 6/1969 | Van Steenburgh, Jr. | |
| 3,610,482 | A | 10/1971 | Van Steenburgh, Jr. | |
| 3,613,389 | A | 10/1971 | Ohisson et al. | |
| 3,626,486 | A | 12/1971 | Bugbee et al. | |
| 3,918,617 | A | 11/1975 | Gregg | |
| 4,349,128 | A | 9/1982 | Sanfilippo | |
| 4,406,395 | A * | 9/1983 | Scoggins | 232/43.1 |
| 4,469,210 | A | 9/1984 | Blumer et al. | |
| 4,480,441 | A | 11/1984 | Schulze-Berge et al. | |
| 4,489,567 | A | 12/1984 | Kohl | |
| 4,498,607 | A | 2/1985 | Jaschinski | |

(Continued)

FOREIGN PATENT DOCUMENTS

| | | |
|---|---|---|
| CA | 2538283 | 4/2005 |

(Continued)

*Primary Examiner*—William E Tapolcai
(74) *Attorney, Agent, or Firm*—Sutherland Asbill & Brennan LLP

(57) ABSTRACT

Embodiments of the invention include methods and apparatus to reduce or prevent bridging in an ice storage bin. In one embodiment, a storage bin for ice with an apparatus to reduce or prevent bridging within the ice storage bin is provided. The apparatus can include a probe hole positioned above an access door and opening, and also above an internal baffle. The probe hole can be sized to receive a probe used to break up bridges or clumps of ice within the ice storage bin.

20 Claims, 7 Drawing Sheets

U.S. PATENT DOCUMENTS

| | | | | |
|---|---|---|---|---|
| 4,537,331 | A | 8/1985 | Matula | |
| 4,550,572 | A | 11/1985 | Schulze-Berge | |
| 4,562,941 | A | 1/1986 | Sanfilippo | |
| 4,640,403 | A | 2/1987 | McDermott | |
| 4,706,553 | A | 11/1987 | Sharp et al. | |
| 4,767,286 | A | 8/1988 | Kohl et al. | |
| 4,768,683 | A | 9/1988 | Gold et al. | |
| 4,774,815 | A | 10/1988 | Schlosser | |
| 4,785,641 | A | 11/1988 | McDougal | |
| 4,788,830 | A | 12/1988 | Schreiner et al. | |
| 4,804,145 | A | 2/1989 | Seymour et al. | |
| 4,845,955 | A | 7/1989 | Taylor | |
| 4,848,602 | A | 7/1989 | Yoshimura et al. | |
| 4,878,361 | A | 11/1989 | Kohl et al. | |
| 4,898,002 | A | 2/1990 | Taylor | |
| 4,907,422 | A | 3/1990 | Kohl et al. | |
| 4,913,315 | A | 4/1990 | Wagner | |
| 4,932,223 | A | 6/1990 | Paul et al. | |
| 4,944,654 | A | 7/1990 | Chou et al. | |
| 4,984,360 | A | 1/1991 | Sather et al. | |
| 4,986,088 | A | 1/1991 | Nelson | |
| 5,014,523 | A | 5/1991 | Kohl | |
| 4,706,553 | A | 7/1991 | Sharp et al. | |
| 5,060,484 | A | 10/1991 | Bush et al. | |
| 5,064,404 | A | 11/1991 | Champion | |
| 5,104,007 | A | 4/1992 | Utter | |
| 5,139,183 | A | 8/1992 | Buchser et al. | |
| 5,140,831 | A | 8/1992 | Kohl et al. | |
| 5,172,595 | A | 12/1992 | Bush et al. | |
| 5,193,357 | A | 3/1993 | Kohl et al. | |
| 5,245,841 | A | 9/1993 | Paul et al. | |
| 5,289,691 | A | 3/1994 | Schlosser et al. | |
| 5,408,834 | A | 4/1995 | Schlosser et al. | |
| 5,477,694 | A | 12/1995 | Black et al. | |
| 5,577,490 | A | 11/1996 | Overton, Jr. | |
| 5,586,439 | A | 12/1996 | Schlosser et al. | |
| 5,697,561 | A | 12/1997 | Plank et al. | |
| 5,704,224 | A | 1/1998 | Choi | |
| 5,752,393 | A | 5/1998 | Schlosser et al. | |
| 5,787,723 | A | 8/1998 | Mueller et al. | |
| 5,887,758 | A | 3/1999 | Hawkes et al. | |
| 5,899,248 | A * | 5/1999 | Anderson | 141/358 |
| 5,953,925 | A | 9/1999 | Mueller et al. | |
| 5,979,689 | A | 11/1999 | Lansky | |
| 6,058,731 | A | 5/2000 | Byczynski et al. | |
| 6,134,907 | A | 10/2000 | Mueller et al. | |
| 6,148,621 | A | 11/2000 | Byczynski et al. | |
| D442,973 | S | 5/2001 | Strandell et al. | |
| 6,321,802 | B1 | 11/2001 | Weeks et al. | |
| D463,464 | S | 9/2002 | Strandell et al. | |
| 6,681,580 | B2 | 1/2004 | Shedivy et al. | |
| D486,687 | S | 2/2004 | Strandell | |
| 6,993,929 | B1 | 2/2006 | Funk et al. | |
| 7,249,879 | B2 * | 7/2007 | Nabilsi | 366/195 |
| 2002/0020711 | A1 | 2/2002 | Glass et al. | |
| 2002/0073728 | A1 | 6/2002 | Stensrud et al. | |
| 2002/0078705 | A1 | 6/2002 | Schlosser et al. | |
| 2002/0115433 | A1 | 8/2002 | Baker | |
| 2003/0066306 | A1 | 4/2003 | Renken et al. | |
| 2003/0089120 | A1 | 5/2003 | Kampert et al. | |
| 2003/0126874 | A1 | 7/2003 | Stensrud et al. | |
| 2003/0126877 | A1 | 7/2003 | Stensrud et al. | |
| 2004/0035136 | A1 | 2/2004 | Gist et al. | |
| 2004/0069004 | A1 | 4/2004 | Gist et al. | |
| 2004/0134219 | A1 | 7/2004 | Miller et al. | |
| 2004/0187513 | A1 | 9/2004 | Allison et al. | |
| 2005/0005627 | A1 | 1/2005 | Allison et al. | |
| 2005/0056044 | A1 | 3/2005 | Allison | |
| 2005/0081545 | A1 | 4/2005 | Gist et al. | |
| 2005/0150250 | A1 | 7/2005 | Allison et al. | |
| 2005/0166612 | A1 | 8/2005 | Allison et al. | |
| 2006/0005565 | A1 | 1/2006 | Roth et al. | |
| 2006/0026985 | A1 | 2/2006 | Hollen et al. | |
| 2006/0112714 | A1 * | 6/2006 | Goff et al. | 62/340 |

FOREIGN PATENT DOCUMENTS

| | | | |
|---|---|---|---|
| CN | 1152105 | | 6/1997 |
| CN | 1412507 | | 4/2003 |
| CN | 2727658 | | 9/2005 |
| CN | 2727659 | | 9/2005 |
| EP | 1228336 | | 8/2002 |
| EP | 1293737 | A2 | 3/2003 |
| EP | 1347256 | A2 | 9/2003 |
| EP | 1510767 | A2 | 3/2005 |
| EP | 1510767 | A3 | 4/2005 |
| FR | 2785371 | A1 | 5/2000 |
| GB | 2304880 | A | 3/1997 |
| GR | 3029642 | | 6/1999 |
| JP | 60187990 | | 9/1985 |
| JP | 2033587 | | 2/1990 |
| JP | 06315929 | A2 | 11/1994 |
| JP | 10281603 | | 10/1998 |
| JP | 10300299 | | 11/1998 |
| JP | 11211297 | | 8/1999 |
| JP | 200213841 | A | 8/2000 |
| TW | 589443 | B | 6/2004 |
| WO | 00/75579 | A1 | 12/2000 |
| WO | 01/35037 | A1 | 5/2001 |
| WO | 02/23105 | A1 | 3/2002 |
| WO | 02/27249 | A3 | 4/2002 |
| WO | 02/065031 | A1 | 8/2002 |
| WO | 03/067164 | A2 | 8/2003 |
| WO | 03/067164 | A3 | 8/2003 |
| WO | 03/098131 | A1 | 11/2003 |
| WO | 2004/081466 | A2 | 9/2004 |
| WO | 2004/102087 | A2 | 11/2004 |
| WO | 2004/102087 | A3 | 11/2004 |
| WO | 2004/081466 | A3 | 4/2005 |
| WO | 2005/035430 | A2 | 4/2005 |
| WO | 2005/038362 | A1 | 4/2005 |
| WO | 2005/057100 | A2 | 6/2005 |
| WO | 2005/074562 | A2 | 8/2005 |

* cited by examiner

METHODS AND APPARATUS TO REDUCE OR PREVENT BRIDGING IN AN ICE STORAGE BIN

RELATED APPLICATION

This application claims priority to U.S. Ser. No. 60/808,008, entitled "Methods and Apparatus to Reduce or Prevent Bridging in an Ice Storage Bin," filed on May 24, 2006, the contents of which are incorporated by reference.

FIELD OF THE INVENTION

The invention generally relates to ice making, and more particularly relates to methods and apparatus to reduce or prevent bridging in an ice storage bin.

BACKGROUND OF THE INVENTION

Ice has long been used for various commercial and domestic demands. In the domestic context, ice making machines and storage bins are typically located in a freezer portion of a refrigerator or in a free-standing freezer. These domestic ice machines and storage bins are typically designed to hold only a relatively small amount of ice.

In the commercial context, there is typically a need for greater quantities of ice than in the domestic context. Some examples of commercial uses of ice include beverage and ice machines at restaurants, convenience stores, or hotels, but there are many other examples that require relatively large quantities of ice. In the commercial context ice can be stored in generous quantities within a relatively large bin, such as the bins described in U.S. Pat. Nos. 5,887,758 and 4,903,866. Relatively large quantities of ice can be stored in the bin and there is typically an access opening to provide a user access to the ice. Also, bins typically have a baffle or other means to prevent the ice from spilling out of the bin.

Several types of access openings are known in the art. For example, Japanese Patent Publication No. 10-238917 has a hinged door that swings outward from the storage bin and away from the ice stored inside the bin. On the other hand, some ice storage bins have hinged doors that swing inward towards the ice.

Also, there are several types of baffles known in the art. A baffle is a device as described in Japanese Patent Publication No. 10-238917 that protrudes into the storage bin and baffles ice away from or otherwise directs ice to particular portions of the bin. When ice is subsequently removed from the storage bin, ice that was previously located behind or on top of the baffle can flow towards the baffle, and such ice can be baffled away from or otherwise directed to particular portions of the bin.

A difficulty in holding large quantities of ice in a storage bin is the propensity of the ice to "bridge" over time, making it difficult to dispense the ice from the storage bin. That is, when ice is stored in a large bin, some of the ice might melt slightly and then re-freeze in clumps, also called bridges. For example, ice might melt if some inner surfaces of the bin are at a relatively higher temperature than other inner surfaces of the bin. When the ice melts, liquid can form on the surface of the ice. In some instances, the liquid can re-freeze, causing the ice to become stuck together in clumps, thereby bridging. When ice bridges, the ice becomes more difficult to dispense from the storage bin.

Typically ice bridges can be broken up by stabbing or poking the bridge with a blunt object, such as an ice scoop or the user's hand. This solution can cause sanitary problems, however, if the blunt object is dirty and contaminates the ice. Ice bridging can be problematic when the ice bridges or otherwise forms on top of an internal baffle within the storage bin. In this situation, the bridge cannot be broken up because the baffle may prevent the user from reaching or otherwise contacting the ice bridge, for example, with a blunt object. In these instances, the ice bridge can prevent or otherwise inhibit ice from being dispensed or accessed from within the storage bin. In other instances, ice bridges could cause structural damage to the baffle or other internal storage bin components.

SUMMARY OF THE INVENTION

Embodiments of the invention can provide a storage bin for ice with an apparatus to reduce or prevent bridging within the storage bin. Embodiments of the invention can provide an apparatus to reduce or prevent bridging such as a probe hole through which to insert a probe to break up the ice bridge. Further embodiments of the invention can provide an ice bin having an apparatus to prevent or reduce ice bridging, in particular, ice bridging above an internal baffle.

In one embodiment of the invention, a method of reducing ice bridging in an ice storage bin with an access opening is provided. The method can include providing an ice storage bin with an access opening. In addition, the method can include mounting at least one baffle relative to an upper portion of an access opening in the ice storage bin, wherein the at least one baffle is adapted to deflect falling ice away from the access opening. Furthermore, the method can include providing at least one probe hole above the access opening and the at least one baffle, wherein the at least one probe hole is adapted to receive a probe adapted to manipulate ice within the ice storage bin and away from the access opening.

In one aspect of this embodiment, the at least one baffle can be a non-sliding baffle or a pivotable baffle.

In another aspect of this embodiment, providing at least one probe hole above the access opening and the at least one baffle can include providing a frame adapted to mount to a surface of the ice storage bin and adjacent to the access opening.

In another aspect of this embodiment, the at least one baffle comprises a lip and the upper surface of the access opening comprises a corresponding lip adapted to permit mounting of the at least one baffle adjacent to the access opening.

In yet another aspect of this embodiment, mounting at least one baffle relative to an upper portion of an access opening in the ice storage bin can include mounting the at least one baffle adjacent to an upward angled section of a frame adapted to mount to a surface of the ice storage bin and adjacent to the access opening.

In another aspect of this embodiment, the method can include providing an access door to cover the access opening and probe hole to limit access to ice within the ice storage bin.

In another embodiment of the invention, a system for reducing ice bridging in an ice storage bin with an access opening can be provided. The system can include an ice bin with an access opening. The system can also include at least one baffle adjacent to an upper surface of the access opening, wherein the at least one baffle is adapted to deflect falling ice away from the access opening. In addition, the system can include at least one probe hole above the access opening and the least one baffle, wherein the at least one probe hole is adapted to receive a probe adapted to fit within the at least one probe hole, and further adapted to manipulate ice within the ice storage bin and away from the access opening.

In one aspect of this embodiment, the at least one baffle can be a non-sliding baffle or a pivotable baffle.

In another aspect of this embodiment, the at least one probe hole and the at least one baffle are mounted to a frame adapted to mount to a surface of the ice storage bin and adjacent to the access opening.

In another aspect of this embodiment, the at least one baffle mounts to an upward angled section of a frame adapted to mount to a surface of the ice storage bin and adjacent to the access opening.

In another aspect of this embodiment, the at least one baffle comprises a lip and the upper surface of the access opening comprises a corresponding lip adapted to permit mounting of the at least one baffle adjacent to the access opening.

In another aspect of this embodiment, the system can include an access door to cover the access opening and probe hole to limit access to ice within the ice storage bin.

In another embodiment of the invention, an apparatus for reducing ice bridging in an ice storage bin with an access opening is provided. The apparatus can include a frame adapted to mount to a surface of the ice storage bin and adjacent to the access opening. The frame can include a baffle for mounting adjacent to an upper surface of the access opening, wherein the baffle is adapted to deflect falling ice away from the access opening. In addition, the frame can include at least one probe hole in a surface of the frame, wherein the probe hole is positioned above the baffle and adapted to receive a probe adapted to manipulate ice within the ice storage bin and away from the access opening. Furthermore, the apparatus can include an access door adapted to cover the access opening and the at least one probe hole to limit access to ice within the ice storage bin.

In one aspect of this embodiment, the at least one baffle can be a non-sliding baffle or a pivotable baffle.

In another aspect of this embodiment, the at least one baffle mounts to an upward angled section of the frame.

In another aspect of this embodiment, the at least one baffle comprises a lip and the frame comprises a corresponding lip adapted to permit mounting of the at least one baffle adjacent to the access opening.

In yet another aspect of this embodiment, the apparatus includes an access door to cover the access opening and probe hole to limit access to ice within the ice storage bin.

In yet another embodiment, a method of assembling an ice storage bin is provided. The method can include providing an ice storage bin with an access opening. In addition, the method can include providing a frame adapted to mount to a surface of the ice storage bin and adjacent to the access opening. The frame can include at least one baffle for mounting adjacent to an upper surface of the access opening, wherein the baffle is adapted to deflect falling ice away from the access opening. In addition, the frame can include at least one probe hole in a surface of the frame, wherein the probe hole is positioned above the baffle and adapted to receive a probe adapted to manipulate ice within the ice storage bin and away from the access opening. Furthermore, the method can include mounting the frame adjacent to the access opening, such that a portion of the baffle extends into the access opening and ice storage bin. Moreover, the method can include mounting an access door to the frame, wherein the access door is adapted to cover the access opening and the at least one probe hole to limit access to ice within the ice storage bin.

In one aspect of this embodiment, the at least one baffle can be a non-sliding baffle or a pivotable baffle.

In another aspect of this embodiment, the at least one baffle mounts to an upward angled section of a frame.

In another aspect of this embodiment, the at least one baffle comprises a lip and the frame comprises a corresponding lip adapted to permit mounting of the at least one baffle adjacent to the access opening.

Other embodiments and aspects of the invention will become apparent from the following description taken in conjunction with the following drawings.

BRIEF DESCRIPTION OF THE DRAWINGS

These and other aspects, features, and advantages of the present invention are better understood when the following Detailed Description is read with reference to the accompanying drawings, wherein.

DETAILED DESCRIPTION OF EMBODIMENTS

FIGS. 1-6 illustrate an example ice storage bin 10 and apparatus 12 to reduce or prevent bridging of ice within the storage bin in accordance with an embodiment of the invention. A suitable ice storage bin 10 can have an ice-making machine or component mounted on top of the bin (not shown). The ice-making machine could produce ice and deposit it directly into the bin 10. Alternatively, there could be a separate ice-making machine or component, and the bin 10 could have an upper opening for a user to manually transfer and deposit ice that is produced from the ice-making machine into the upper opening of the storage bin. For example, the ice bin 10 shown in FIG. 1 has an upper, horizontally aligned opening where ice from a separate ice-making machine or component could be transferred to or otherwise deposited into the storage bin 10.

The embodiment of the ice storage bin 10 shown in FIGS. 1-6 also includes an access door 14 and associated access opening beneath the access door 14 to provide a user access to the contents of the storage bin 10 when desired. The access door and opening may have any configuration or shape, for example, a hinged access door over an access opening, or a slideable access door.

Figure 5:
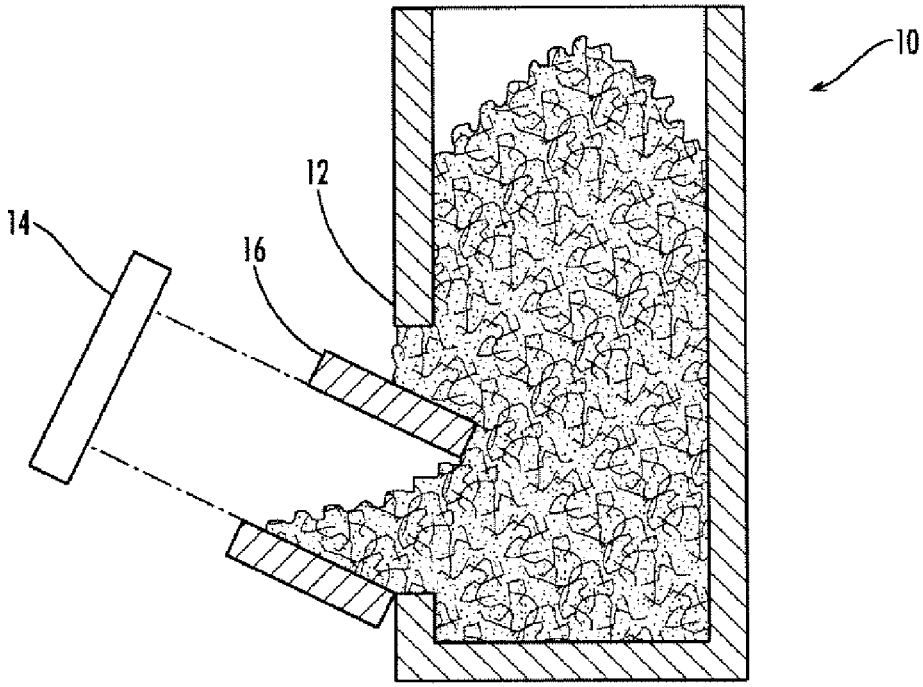
FIG. 5 shows an exploded side sectional view of the ice storage bin of FIGS. 1-4, in accordance with an embodiment of the invention.
Figure 6:
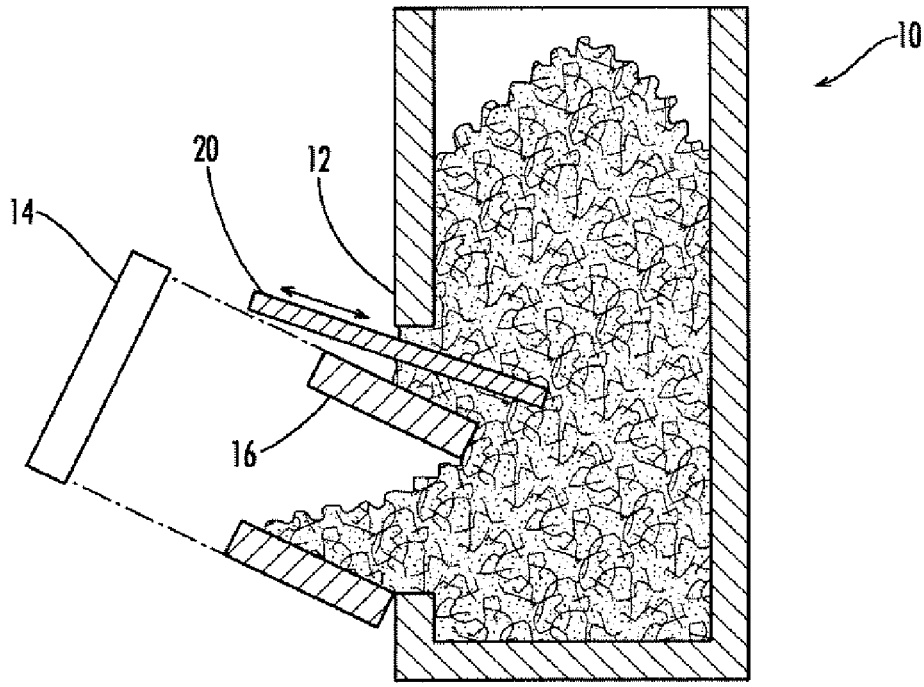
FIG. 6 shows the ice storage bin of FIGS. 1-5 with a probe inserted through a probe hole, in accordance with an embodiment of the invention.

The embodiment of the ice storage bin 10 shown in FIGS. 1-6 also includes a baffle 16. The baffle 16 shown can protrude into the interior portion of the bin 10. In the embodiment shown, the baffle 16 is a non-sliding baffle. One purpose of the baffle 16 is to baffle ice away from or otherwise direct ice to particular portions of the bin 10. The baffle 16 can be any suitable shape or configuration to deflect falling ice away from the access opening, and towards a particular portion of the bin. As shown in the example of FIGS. 5 and 6, the baffle 16 can be positioned adjacent to an upper portion of the access door 14 and opening. In this manner, the baffle 16 can be used for reducing or preventing bridging of ice within the ice storage bin 10.

The apparatus shown, for example, a probe hole 12, can also be used for reducing or preventing bridging of ice within the ice storage bin 10. The probe hole 12 can be sized to receive a probe 20 or other device for breaking ice bridges or clumps within an ice storage bin. In the embodiment shown, the probe 20 can be inserted into the bin 10 as needed. The probe 20 can be removed from the bin 10, and is generally provided separately from the bin 10 and probe hole 12. By way of inserting the probe 20 into the probe hole 12, the probe 20 can be used to stab at and break up any ice bridges or clumps in the bin 10 and in proximity to the probe hole 12. The probe hole 12 can be of any suitable shape, including round, rectangular, or square. As shown in the figures, the example probe hole 12 is rectangular-shaped. This configuration of the probe hole 12 allows the probe 20 to be moved in and out of the bin 10, and also side to side within the bin 10. As the probe 20 is moved into the bin 10, any ice bridges or clumps adjacent to the upper surface of the baffle 16 can be broken up before progressing past and, in some instances, below the baffle 16. In this manner, use of the probe hole 12 and probe 20 can reduce or otherwise prevent bridging within an ice storage bin, and reduce the possibility of damage to the baffle or other internal bin components caused by ice bridging.

As shown in FIGS. 2-6, the probe hole 12 can be covered by the access door 14 and is positioned slightly above the access opening. In other embodiments, the probe hole can be positioned in other locations relative to the access opening, and may only be partially covered by, or not covered at all by the access door 14.

Furthermore, in this example, the probe hole 12 is also positioned slightly above the baffle 16. In other embodiments, the probe hole 12 can be positioned in other locations, such as slightly above and not covered at all by the access door 14.

Other embodiments of an apparatus for reducing or preventing bridging can include a probe that is mounted to or otherwise connected to the storage bin. For example, a mounted probe can include a first portion that partially protrudes into a storage bin, and a second portion that extends away from the bin and remains exterior to the bin. The second portion could be used as a handle for a user to grip the probe and to manipulate the first portion towards any ice bridges or clumps within the ice storage bin.

Figure 1:
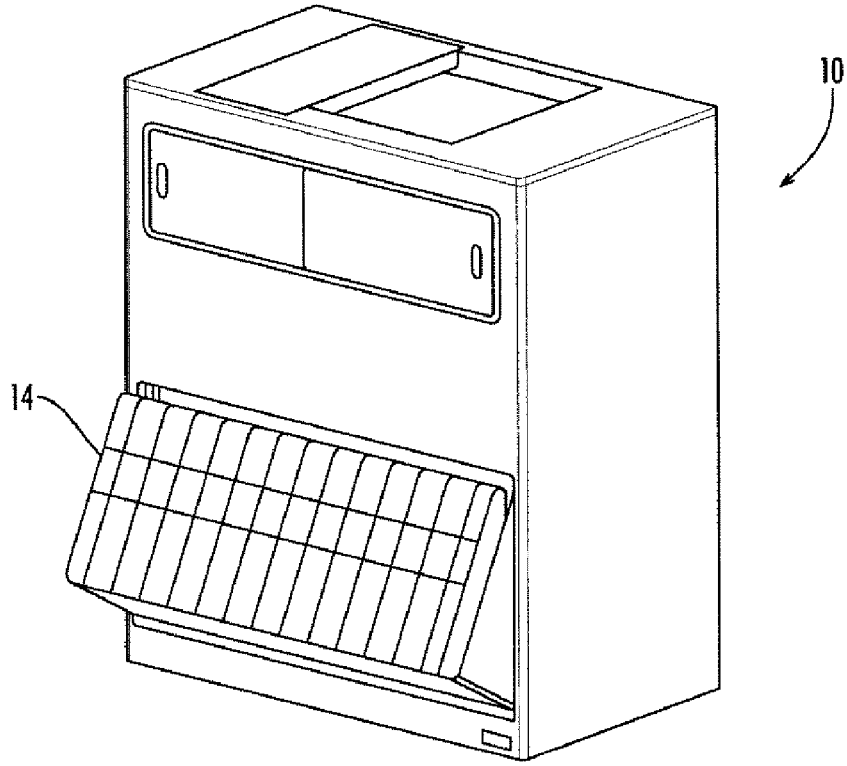
FIG. 1 shows an isometric view of an ice storage bin in accordance with an embodiment of the invention.
Figure 2:
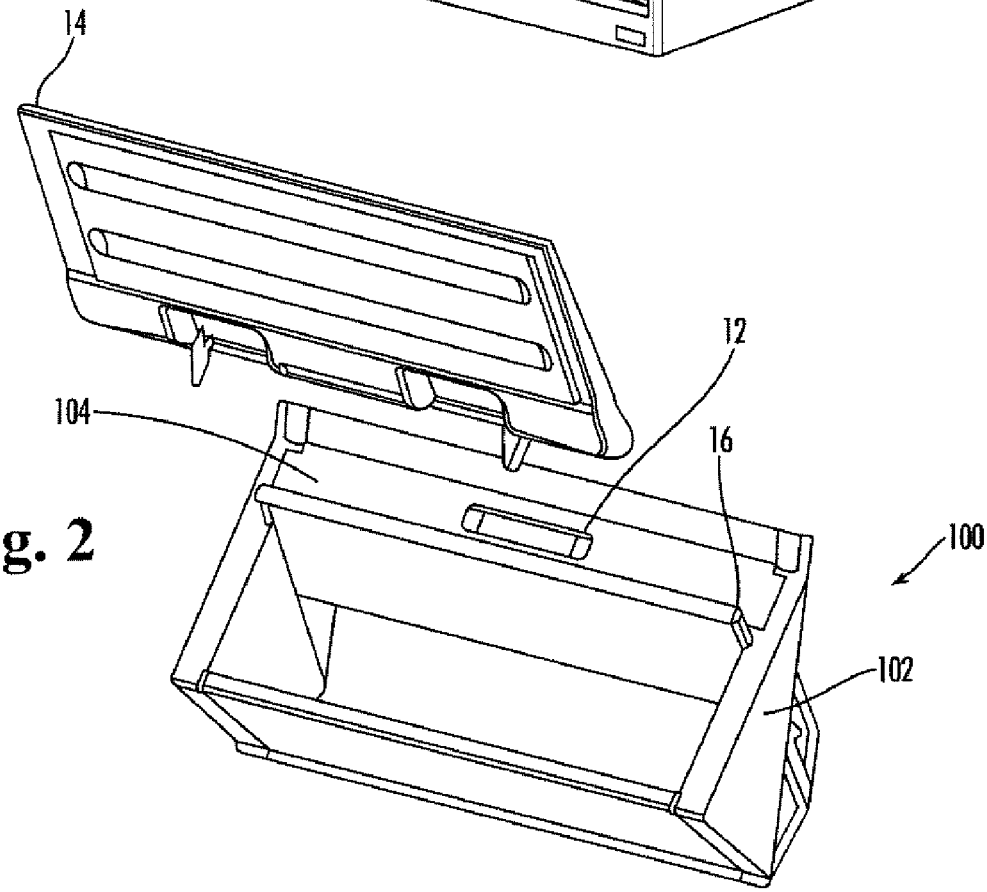
FIG. 2 shows an exploded isometric view of a portion of the ice storage bin of FIG. 1, in accordance with an embodiment of the invention.
Figure 3:
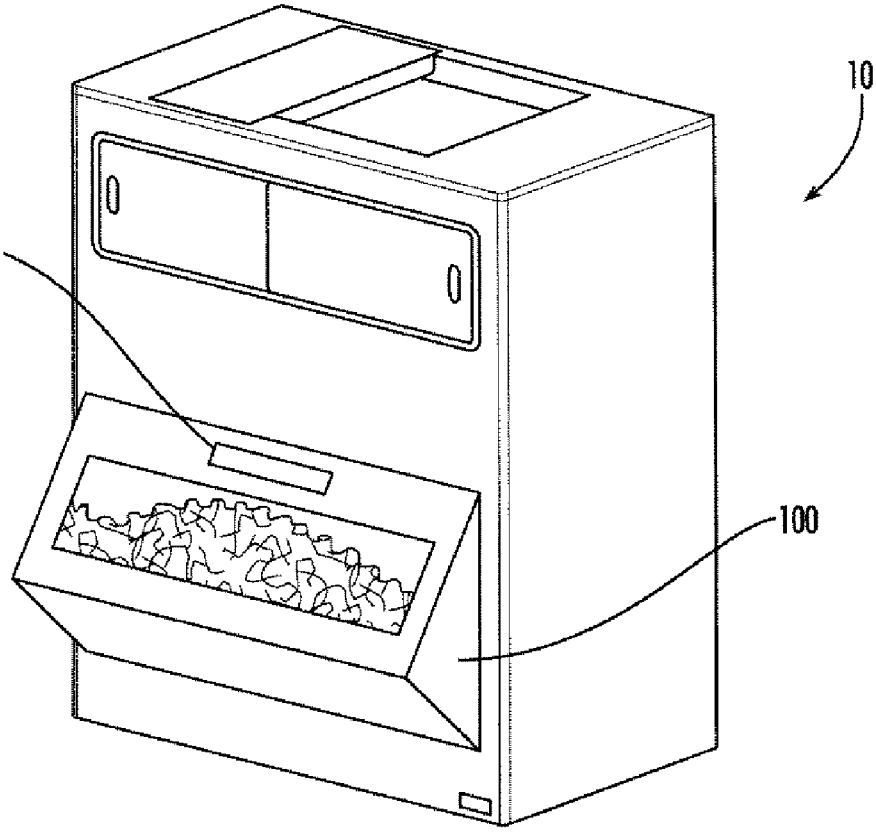
FIG. 3 shows an isometric view of the ice storage bin of FIGS. 1-2 with the access door removed, in accordance with an embodiment of the invention.
Figure 4:
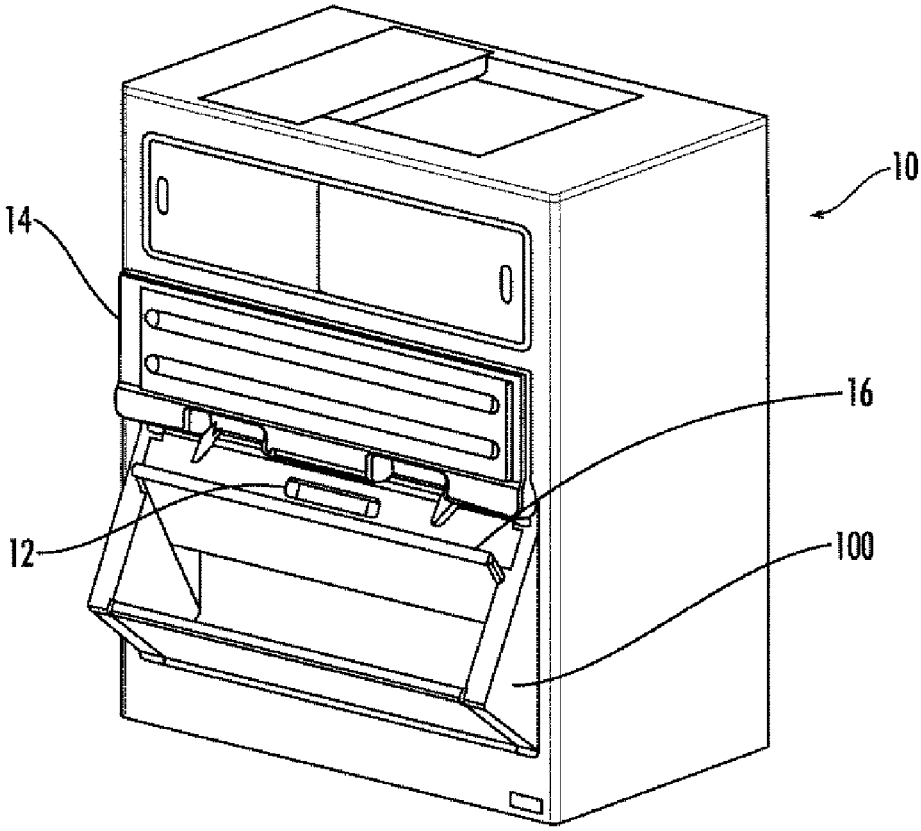
FIG. 4 shows an isometric view of the ice storage bin of FIGS. 1-3 with the access door in an open position, in accordance with an embodiment of the invention.

In one embodiment, as shown in FIG. 2, an apparatus such as a snout 100 can include a probe hole 12, an access door 14, and a baffle 16. The apparatus can be mounted to an ice storage bin, such as 10, adjacent to an access opening in the storage bin. In the example shown, the snout 100 can include a frame 102 which can mount to a surface of the ice storage bin 10 such that a portion of the frame mounts over or in close proximity to the access opening of the bin 10. For instance, the snout 100 shown in FIG. 2 is shown mounted to the ice storage bin in FIGS. 1, 3, and 4. In this manner, the apparatus such as snout 100 can be used for reducing or preventing bridging of ice within the ice storage bin 10.

In the embodiment shown in FIG. 2, the frame 102 can generally be rectangular-shaped with an upward angled section 104. The upward angled section 104 can include a surface for the probe hole 12 and corresponding mounts for the mounting of the access door 14. Within the frame 102, the baffle 16 can be mounted to a relatively fixed position within the snout 100 using corresponding mounts. In one example, when the snout is assembled as shown in FIG. 2, the snout 100 can be mounted to an ice storage bin, such as 10, using mounting devices such as screws, bolts, adhesive, or other mounting-type devices, such that a portion of the snout 100 mounts over or in close proximity to the access opening of the bin 10. In this manner, the probe hole 12, access door 14, and baffle 16 can be utilized as previously described above.

Figure 7:
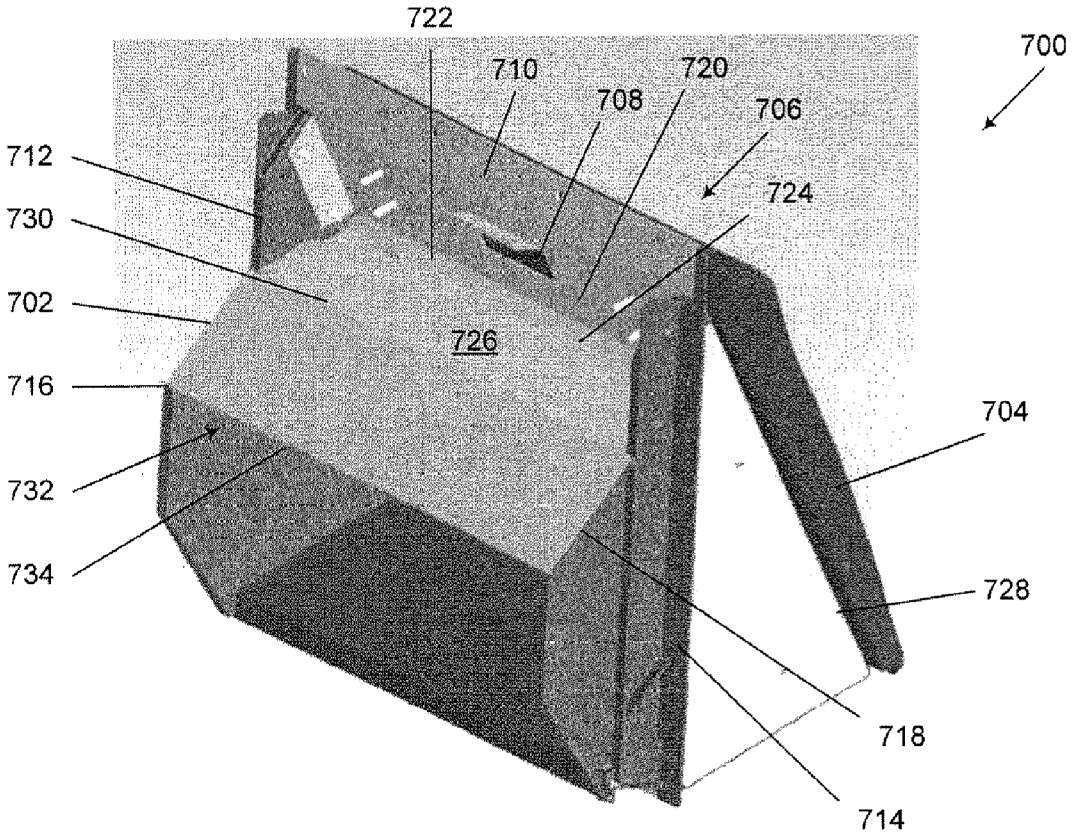
FIG. 7 illustrates a perspective view of an apparatus for an ice storage bin with a baffle in a relatively lower position, according to another embodiment of the invention.
Figure 8:
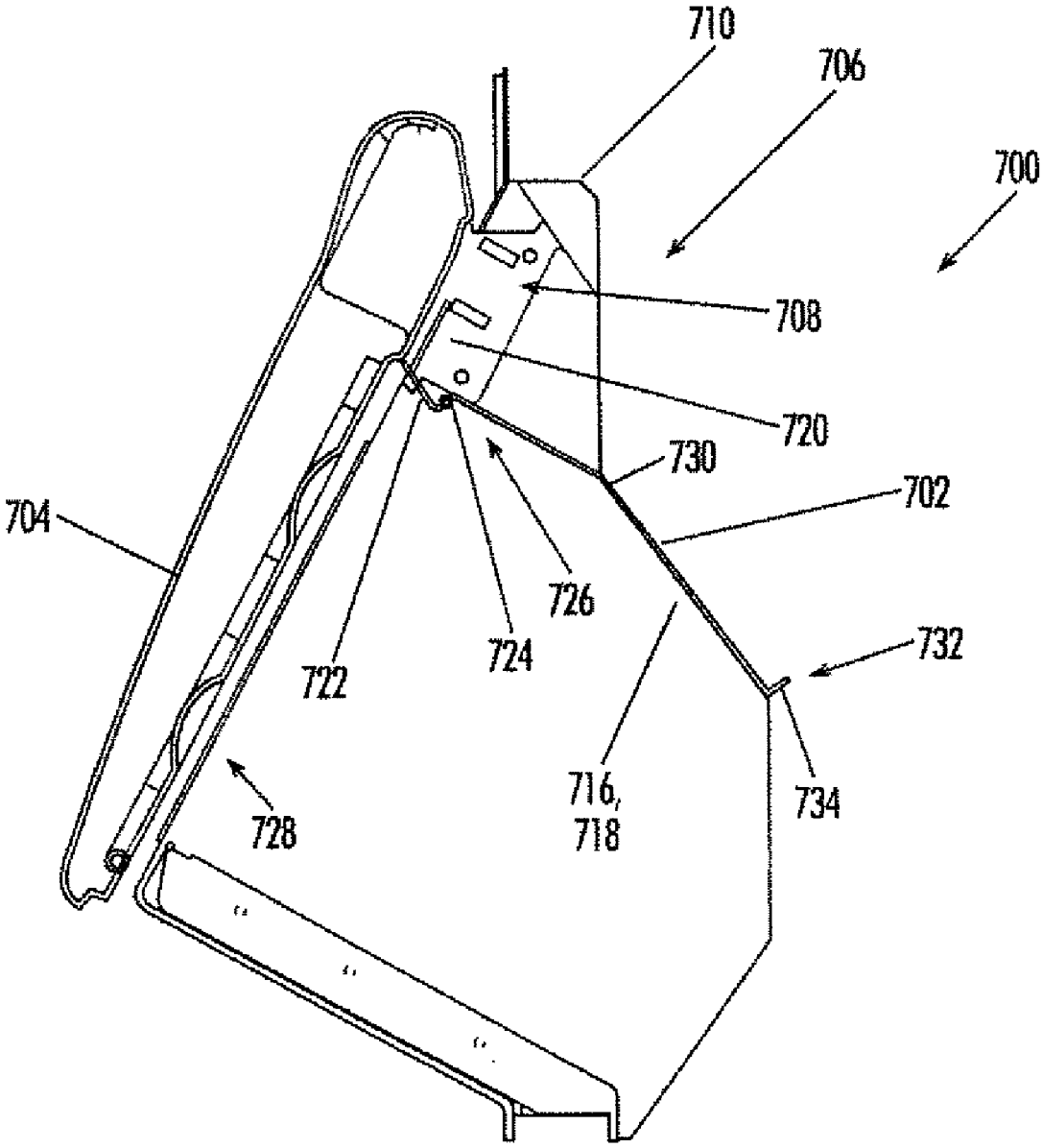
FIG. 8 illustrates a side view of the apparatus shown in FIG. 7.
Figure 9:
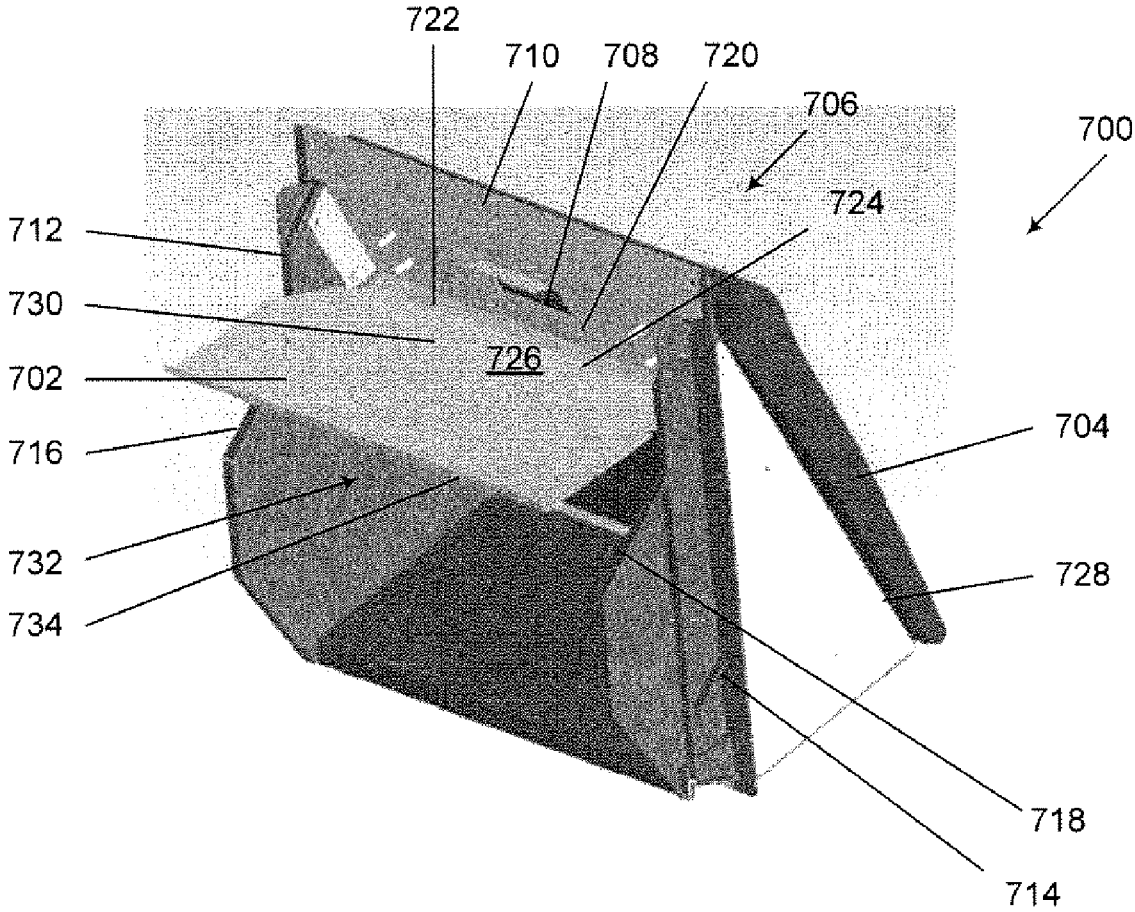
FIG. 9 illustrates a perspective view of the apparatus for an ice storage bin with a baffle in a relatively upper position, according to another embodiment of the invention.
Figure 10:
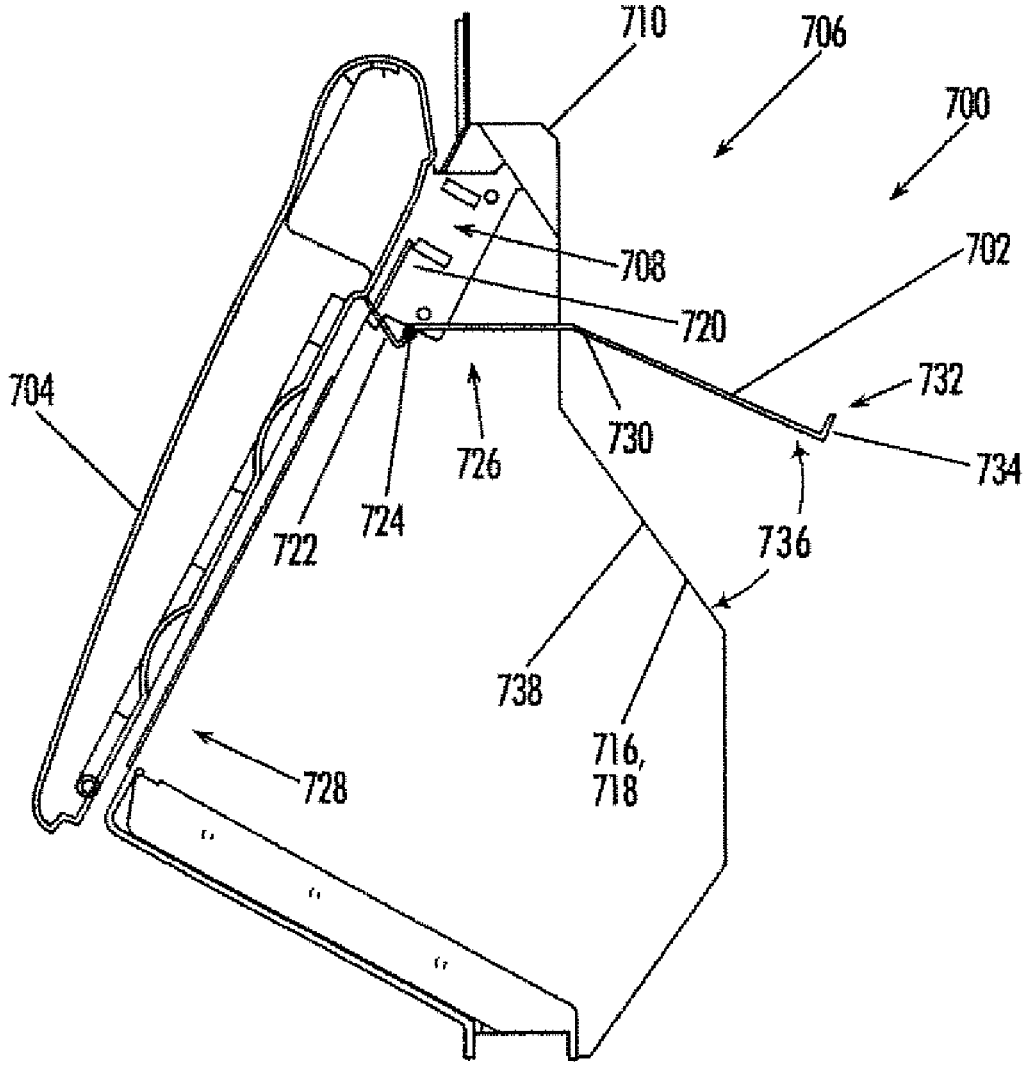
FIG. 10 illustrates a side view of the apparatus shown in FIG. 9.

FIGS. 7-10 illustrate another example system and apparatus for an ice storage machine according to another embodiment of the invention. FIGS. 7 and 8 illustrate the apparatus 700 with a baffle 702 in a relatively lower position. FIGS. 9 and 10 illustrate the apparatus 700 with the baffle 702 in a relatively upper position. The baffle 702 in FIGS. 7-10 can baffle ice away from or otherwise direct ice to particular portions of an ice storage bin, such as 10 in FIG. 1. The baffle 702 can be any suitable shape or configuration to deflect falling ice away from the access opening, and towards a particular portion of the bin. As shown in the example of FIGS. 7 and 8, the baffle 702 can be positioned in a lowered position adjacent to an upper portion of an ice access cover door 704 and associated ice access opening. Likewise, in the example of FIGS. 9 and 10, the baffle 702 can be positioned in an elevated position adjacent to an upper portion of an ice access cover door 704 and associated opening. In this manner, the baffles 702 can be used for reducing or preventing bridging of ice within the ice storage bin, such as 10.

As shown in FIGS. 7-10, the apparatus 700 shown can also include an ice access cover door 704, a snout section 706, and at least one probe port 708. The snout section 706 can include a frame 710, which can include one or more internally disposed surfaces operable to support a baffle, such as 702. For example, in the embodiment shown in FIG. 7, the snout section 706 can include a rectangular-shaped frame 710 with two internally disposed lateral sides 712, 714 which are oriented in a substantially vertical position, and one or more relatively horizontal elements 716, 718 disposed between the lateral sides 712, 714. The lateral sides 712, 714 can be spaced apart from each other by approximately the width of the snout section 706. Each of the lateral sides 712, 714 can include a relatively flat angled surface 716, 718 operable to support a portion of the baffle 702 adjacent to an upper portion of each respective lateral side 712, 714. Other embodiments can include other shapes or configurations of internally disposed surfaces operable to support a baffle, Furthermore, at least one of the horizontal elements, such as 720, adjacent to an upper portion of the frame 710 can include an upward angular-shaped lip, shown as 722 in FIG. 8, operable to receive a corresponding lip, shown as 724 in FIG. 8, associated with a trailing edge 726 of the baffle 702. Other embodiments of an apparatus and baffle can include other devices, or shapes or configurations of corresponding lips.

Between the lateral sides 712, 714 and adjacent to one or more of the horizontal elements, such as 716, an ice access opening 728 can be defined. In the embodiment shown, the ice access cover door 704 can be mounted to an external surface associated with the frame 710 to cover the ice access opening 728, and optionally, one or more probe ports, such as 708.

The baffle 702 shown in FIGS. 7-10 can generally be a rectangular-shaped plate. In the embodiments shown in FIGS. 7-10, the baffle 702 can be slightly concave with a slight angle 730 or bend across the width of the baffle 702. A leading edge 732 of the baffle 702 can include an upward angle or bend defining a lip 734, which can extend at least a portion across the width of the baffle 702. Likewise, the trailing edge 726 of the baffle 702 can include a downward angle or bend defining lip 724, which can extend at least a portion across the width of the baffle 702. The lip 734 associated with the trailing edge 732 of the baffle 702 can be operable to receive or otherwise cooperate with a corresponding lip, described above as 722, or other device associated with at least one horizontal element, such as 720 described above, or a lateral side 712, 714 associated with the frame 710.

In one embodiment, a lip associated with a baffle can include multiple bends or angles defining multiple lips. One or more of the multiple lips can correspond or otherwise cooperate with one or more lips or other devices associated with at least one horizontal element or side associated with the frame.

In any instance, a portion of the baffle 702 can contact at least a portion of the each of the lateral sides 712, 714 such that the baffle 702 can maintain its position relative to the frame 710 as shown in FIGS. 7 and 8. In the embodiment shown, when the baffle 702 is in contact with either or both of the lateral sides 712, 714, the baffle 702 is in a relatively lower position. Likewise, the baffle 702 can be raised above either or both lateral sides 712, 714 while the lip 724 associated with the trailing edge 726 of the baffle 702 maintains contact with the lip 722 associated with a horizontal element, such as 720, as shown in FIGS. 9 and 10. In this manner, the elevation of the leading edge 732 of the baffle 702 can be adjusted vertically with respect to the lateral sides 712, 714 to provide a greater or lesser baffle angle, shown as 736 in FIG. 10, with respect to the frame 710. In some instances, adjustment of the baffle angle 736 may be desired or necessary to reduce ice bridging within the ice storage bin, such as 10. In the embodiment shown in FIG. 10, the baffle angle 736 is defined as the angle between a plane 738 and the leading edge 732 of the baffle 702.

In use, the baffle 702 shown in FIGS. 7-10 can be used to baffle ice away from or otherwise direct ice to particular portions of an ice storage bin, such as 10 in FIG. 1. When the baffle 702 is in a relatively lowered position as shown in FIGS. 7 and 8, falling ice may deposit on an upper surface of the baffle 702, and as ice accumulates within the bin, the weight of the ice may tend to press the baffle 702 downward against the flat angled surfaces 716, 718 associated with the lateral sides 712, 714.

The baffle and frame configuration for the apparatus embodiment shown in FIGS. 7-10 also permits a baffle to removed from an ice storage bin. In many instances, this may be necessary for cleaning, maintenance, or other operational purposes. For example, removal of a baffle, such as 702, can be accomplished, for example, by lifting a trailing portion 726 of the baffle 702 away from the horizontal element 720, such that the lip 724 associated with the trailing edge 726 of the baffle 702 disengages from contact with the corresponding lip 722 associated with the horizontal element 720.

An additional aspect of the apparatus shown in FIGS. 7-10 is a probe port. One or more probe ports 708 can be located slightly above the baffle 702, and machined in a portion of a horizontal element, such as 720. The probe ports 708 can be sized to receive an ice probe, similar to 20 in FIG. 6, wherein a user can reduce ice bridging within the ice storage bin 10 by inserting the probe 20 within the probe port 708 and manipulating the probe 20 within the ice storage bin 10. As shown in FIGS. 7 and 9, a probe port 708 can be rectangular-shaped, and can extend along an intermediate portion of one of the at least one of the horizontal elements, such as 720, of the frame 710. Other embodiments of a probe port can include multiple holes, and other shapes, sizes or configurations of a probe port.

One skilled in the art will recognize other configurations, shapes, and designs for an apparatus can exist in accordance with other embodiments of the invention. It will be recognized by those skilled in the art that changes may be made in the above described embodiments of the invention without departing from the concepts thereof. The invention is not limited to the particular embodiments disclosed, but is intended to cover all modifications that are within the scope of the invention.

The claimed invention is:

1. A method of reducing ice bridging in an ice storage bin with an access opening, the method comprising:

providing an ice storage bin with an access opening, wherein the access opening is through a front surface of the ice storage bin;

mounting at least one baffle relative to an upper portion of the access opening in the ice storage bin, wherein the at least one baffle is adapted to deflect falling ice away from the access opening; and providing at least one probe hole through the front surface of the ice storage bin above the access opening and the at least one baffle, wherein the at least one probe hole is adapted to receive a probe adapted to move in and out of the at least one probe hole to manipulate ice within the ice storage bin and away from the access opening.

2. The method of claim 1, wherein the at least one baffle comprises at least one of the following: a fixed baffle, or a pivotable baffle.

3. The method of claim 1, wherein providing at least one probe hole above the access opening and the at least one baffle comprises providing a frame adapted to mount to a surface of the ice storage bin and adjacent to the access opening.

4. The method of claim 1, wherein mounting at least one baffle relative to an upper portion of an access opening in the ice storage bin comprises mounting the at least one baffle adjacent to an upward angled section of a frame adapted to mount to a surface of the ice storage bin and adjacent to the access opening.

5. The method of claim 1, wherein the at least one baffle comprises a lip and the upper surface of the access opening comprises a corresponding lip adapted to permit mounting of the at least one baffle adjacent to the access opening.

6. The method of claim 1, further comprising providing an access door to cover the access opening and probe hole to limit access to ice within the ice storage bin.

7. A system for reducing ice bridging in an ice storage bin with an access opening, the system comprising:

an ice bin with an access opening, wherein the access opening is through a front surface of the ice bin;

at least one baffle adjacent to an upper surface of the access opening, wherein the at least one baffle is adapted to deflect falling ice away from the access opening;

at least one probe hole through the front surface of the ice bin above the access opening and the least one baffle, wherein the at least one probe hole is adapted to receive a probe adapted to fit within the at least one probe hole, and further adapted to move in and out of the at least one probe hole to manipulate ice within the ice storage bin and away from the access opening.

8. The system of claim 7, wherein the at least one baffle comprises at least one of the following: a fixed baffle, or a pivotable baffle.

9. The system of claim 7, wherein the at least one probe hole and the at least one baffle are mounted to a frame adapted to mount to a surface of the ice storage bin and adjacent to the access opening.

10. The system of claim 7, wherein the at least one baffle mounts to an upward angled section of a frame adapted to mount to a surface of the ice storage bin and adjacent to the access opening.

11. The system of claim 7, wherein the at least one baffle comprises a lip and the upper surface of the access opening comprises a corresponding lip adapted to permit mounting of the at least one baffle adjacent to the access opening.

12. The system of claim 7, further comprising an access door to cover the access opening and probe hole to limit access to ice within the ice storage bin.

13. An apparatus for reducing ice bridging in an ice storage bin with an access opening, the apparatus comprising:

a frame adapted to mount to a front surface of the ice storage bin and adjacent to the access opening, wherein the access opening is through a front surface of the ice storage bin, the frame comprising:

a baffle for mounting adjacent to an upper surface of the access opening, wherein the baffle is adapted to deflect falling ice away from the access opening; and an access door adapted to simultaneously cover the access opening and the at least one probe hole to limit access to ice within the ice storage bin, wherein the access door is opened to insert a probe to manipulate ice within the ice storage bin and away from the access opening.

14. The apparatus of claim 13, wherein the at least one baffle comprises at least one of the following: a fixed baffle, or a pivotable baffle.

15. The apparatus of claim 13, wherein the at least one baffle mounts to an upward angled section of the frame.

16. The apparatus of claim 13, further comprising an access door to cover the access opening and probe hole to limit access to ice within the ice storage bin.

17. A method of assembling an ice storage bin, the method comprising:

providing an ice storage bin with an access opening, wherein the access opening is through a front surface of the ice storage bin;

providing a frame adapted to mount to a surface of the ice storage bin and adjacent to the access opening, the frame comprising:

at least one baffle for stationary mounting adjacent to an upper surface of the access opening, wherein the baffle is adapted to deflect falling ice away from the access opening;

at least one probe hole in a front surface of the frame, wherein the at least one probe hole is positioned above the baffle and adapted to receive a probe adapted to move in and out of the at least one probe hole to manipulate ice within the ice storage bin and away from the access opening;

mounting the frame adjacent to the access opening, such that a portion of the baffle extends into the access opening and ice storage bin; and mounting an access door to the frame, wherein the access door is adapted to simultaneously cover the access opening and the at least one probe hole to limit access to ice within the ice storage bin, wherein the access door is opened to insert a probe to manipulate ice within the ice storage bin and away from the access opening.

18. The method of claim 17, wherein the at least one baffle comprises at least one of the following: a fixed baffle, or a pivotable baffle.

19. The method of claim 17, wherein the at least one baffle mounts to an upward angled section of a frame.

20. The method of claim 17, wherein the at least one baffle comprises a lip and the frame comprises a corresponding lip adapted to permit mounting of the at least one baffle adjacent to the access opening.

* * * * *